US010606188B2

(12) United States Patent
Nieda

(10) Patent No.: US 10,606,188 B2
(45) Date of Patent: Mar. 31, 2020

(54) POWDER CONTAINER, PROCESS CARTRIDGE, AND IMAGE FORMING APPARATUS

(71) Applicant: RICOH COMPANY, LTD., Tokyo (JP)

(72) Inventor: Hiroaki Nieda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/266,152

(22) Filed: Feb. 4, 2019

(65) Prior Publication Data

US 2019/0243285 A1 Aug. 8, 2019

(30) Foreign Application Priority Data

Feb. 6, 2018 (JP) ..... 2018-018887

(51) Int. Cl.
*G03G 15/08* (2006.01)
*G03G 21/18* (2006.01)

(52) U.S. Cl.
CPC ..... *G03G 15/0889* (2013.01); *G03G 21/1814* (2013.01)

(58) Field of Classification Search
CPC ..... G03G 15/0887; G03G 15/0889; G03G 15/0891; G03G 21/1814
See application file for complete search history.

(56) References Cited

U.S. PATENT DOCUMENTS

2008/0240775 A1* 10/2008 Mase ..... G03G 15/0872 399/111

FOREIGN PATENT DOCUMENTS

| | | |
|---|---|---|
| JP | 9-185232 | 7/1997 |
| JP | 2005-031143 | 2/2005 |
| JP | 2010-060597 | 3/2010 |

* cited by examiner

*Primary Examiner* — Hoang X Ngo
(74) *Attorney, Agent, or Firm* — Xsensus LLP

(57) ABSTRACT

A powder container includes a rotator and a coil disposed adjacent to the rotator. The rotator is configured to rotate in a predetermined direction. The coil is configured to be rotated by contact with the rotator and divided into a plurality of divided coil portions along a rotation center of the coil in an axial direction of the coil. A plurality of coil centers of the plurality of divided coil portions is eccentric relative to the rotation center.

20 Claims, 11 Drawing Sheets

POWDER CONTAINER, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-018887, filed on Feb. 6, 2018, in the Japan Patent Office, the entire disclosure of which is hereby incorporated by reference herein.

BACKGROUND

Technical Field

This disclosure generally relates to a powder container to store powder therein, a process cartridge including the powder container, and an image forming apparatus, such as a copier, a printer, a facsimile machine, or a multifunction peripheral (MFP) having such a function.

Description of the Related Art

There is known an image forming apparatus, such as a copier, a printer, and a facsimile machine, including a powder container in which a coil rotates by contact with a rotator to stir powder in the image forming apparatus.

SUMMARY

According to embodiments of the present disclosure, an improved powder container includes a rotator and a coil disposed adjacent to the rotator. The rotator is configured to rotate in a predetermined direction. The coil is disposed adjacent to the rotator and configured to be rotated by contact with the rotator and divided into a plurality of divided coil portions along a rotation center of the coil in an axial direction of the coil. A plurality of coil centers of the plurality of divided coil portions is eccentric relative to the rotation center.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
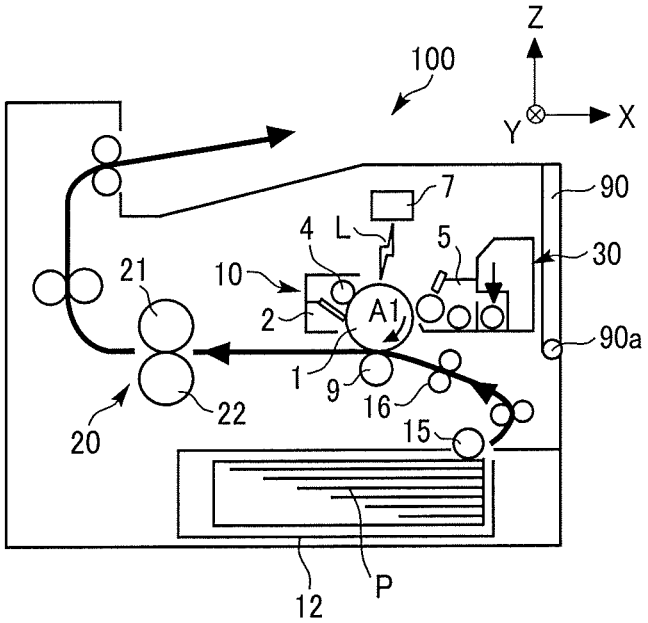
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

With reference to the drawings, embodiments of the present disclosure are described below. It is to be understood that identical or similar reference numerals are assigned to identical or corresponding components throughout the drawings, and redundant descriptions are omitted or simplified below as appropriate.

Now, a description is given of a configuration and operation of an image forming apparatus 100 with reference to FIG. 1.

In FIG. 1, the image forming apparatus 100 that is a printer in the present embodiment includes a photoconductor drum 1 on which a toner image is formed and an exposure device (a writing device) 7. The exposure device 7 irradiates the photoconductor drum 1 with exposure light L based on image data input from an input device such as a personal computer.

The image forming apparatus 100 further includes a transfer roller 9 to transfer the toner image borne on a surface of the photoconductor drum 1 to a sheet P conveyed to a transfer nip (a transfer position); a process cartridge 10 uniting the photoconductor drum 1, a charging roller 4, a developing device 5, a cleaner 2, a waste toner conveyor 6 (see FIG. 2); and a sheet feeder (a sheet tray) 12 to accommodate the sheets P such as paper sheets.

The image forming apparatus 100 yet further includes a registration roller pair (a timing roller pair) 16 to feed the sheet P toward the transfer nip where the photoconductor drum 1 contacts the transfer roller 9, a fixing device 20 to fix an unfixed image on the sheet P, and a toner container (a powder container) 30. The fixing device 20 includes a fixing roller 21 and a pressure roller 22.

Around the photoconductor drum 1, the charging roller 4, the developing device 5, the cleaner 2, and the waste toner conveyor 6 are disposed. The above components (i.e., the photoconductor drum 1, the charging roller 4, the developing device 5, the cleaner 2, and the waste toner conveyor 6) are united as the process cartridge 10. The process cartridge 10 is removably installed in the body of the image forming apparatus 100. The process cartridge 10 is replaced with a new process cartridge in a certain replacement cycle.

Above the process cartridge 10 (the developing device 5) as a removable component, the toner container 30 as the powder container is removably (replaceably) installed in the body of the image forming apparatus 100. The toner container 30 (a toner storage 31) stores toner (fresh toner) as powder. The toner is appropriately supplied from the toner container 30 to the inside of the developing device 5. When the toner container 30 runs out of toner (or toner contained in the developing device 5 is depleted), the toner container 30 is replaced with a new toner container. Note that, the toner container 30 according to the present embodiment further includes a waste toner collection portion (a powder collection portion) 32 in addition to the toner storage (a powder storage) 31. The waste toner collection portion 32 is described in detail later.

Figure 2:
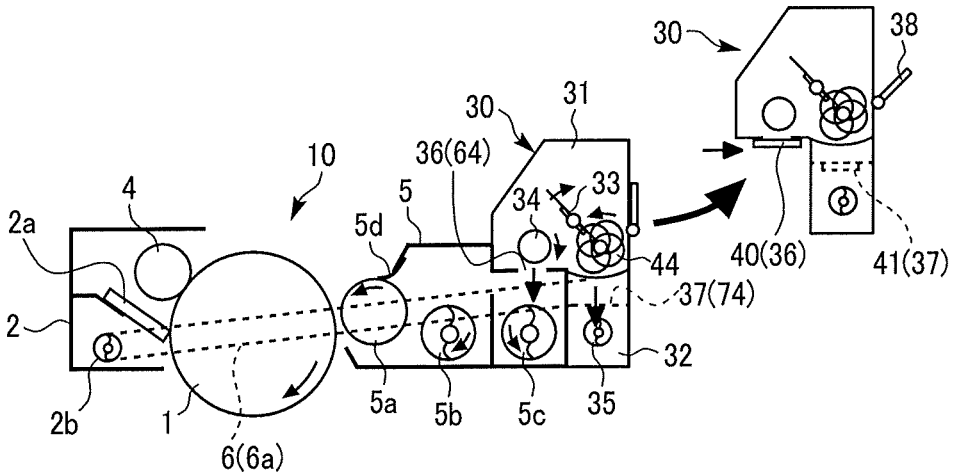
FIG. 2 is a schematic view of a process cartridge and a toner container according to an embodiment of the present disclosure.

Now, a description is given of regular image forming operations performed by the image forming apparatus 100 with reference to FIGS. 1 and 2.

With reference to FIG. 1, as image data is transmitted from the input device, such as a personal computer, to the exposure device 7 in the image forming apparatus 100, the exposure device 7 irradiates the surface of the photoconductor drum 1 with the exposure light (a laser beam) L based on the image data.

Meanwhile, the photoconductor drum 1 rotates in a direction indicated by arrow A1 in FIG. 1, that is, a clockwise direction. The charging roller 4 uniformly charges the surface of the photoconductor drum 1 at a position opposed to each other (a charging process). As a result, a charging potential is formed on the surface of the photoconductor drum 1. In the present embodiment, the charging potential on the photoconductor drum 1 is around −900V. The charged surface of the photoconductor drum 1 thereafter reaches an irradiation position of the exposure light L. An irradiated portion of the photoconductor drum 1 with the exposure light L has a latent image potential (about 0 to −100 V) and an electrostatic latent image is formed on the surface of the photoconductor drum 1 (an exposure process).

The surface of the photoconductor drum 1 bearing the electrostatic latent image thereon reaches a position where the photoconductor drum 1 is opposed to the developing device 5. The developing device 5 supplies toner onto the photoconductor drum 1 and the latent image formed on the photoconductor drum 1 is thereby developed into a toner image (a developing process).

As illustrated in FIG. 2, the developing device 5 includes the developing roller 5*a*, two conveying screws 5*b* and 5*c*, and a doctor blade 5*d*. The developing device 5 contains toner (one-component developer). Toner is supplied from discharge port 36 of the toner container 30 (the toner storage 31) to the developing device 5 via an inlet port 64 of the developing device 5 according to consumption of toner in the developing device 5. The two conveying screws 5*b* and 5*c* stir and mix the supplied toner with toner contained in the developing device 5 while circulating the toner in a longitudinal direction of the developing device 5, perpendicular to the surface of the paper on which FIG. 2 is drawn. The developing roller 5*a* scoops up a part of the toner conveyed by the conveying screw 5*b*. The scooped up toner by the developing roller 5*a* is quantified by the doctor blade 5*d* and reaches a position (a development range) opposed to the photoconductor drum 1. At that time, the toner on the developing roller 5*a* is rubbed by the doctor blade 5*d* and triboelectrically charged. The quantified toner adheres to the electrostatic latent image on the photoconductor drum 1 at the development range, thereby forming the toner image on the photoconductor drum 1. The developing roller 5*a* and the two conveying screws 5*b* and 5*c* are rotated in directions indicated by arrows in FIG. 2 by a drive motor included in the image forming apparatus 100, respectively.

After the developing process, the surface of the photoconductor drum 1 bearing the toner image thereon reaches the transfer nip (the transfer position) formed between the photoconductor drum 1 and the transfer roller 9. In the transfer nip between the photoconductor drums 1 and the transfer roller 9, a transfer bias, which has a polarity opposite to toner, is applied from a power source to the transfer roller 9, and the toner image formed on the photoconductor drum 1 is thereby transferred onto the sheet P fed by the registration roller pair 16 (a transfer process).

The surface of the photoconductor drum 1 after the transfer process reaches a position opposed to the cleaner 2. At this position, untransferred toner remaining on the surface of the photoconductor drum 1 is mechanically removed by a cleaning blade 2*a* and collected in the cleaner 2 (a cleaning process).

A series of image forming processes on the photoconductor drum 1 is thus completed.

A collection screw 2*b* conveys the untransferred toner collected in the cleaner 2 to one end of the cleaner 2 in a width direction (a rotation axis direction) of the collection screw 2*b*. The waste toner conveyor 6 including a waste toner coil 6*a* conveys the untransferred toner in diagonally upper right direction in FIG. 2. Thus, the untransferred toner is collected in the waste toner collection portion 32 of the toner container 30 as waste toner from an outlet port 74 of the waste toner conveyor 6 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the topmost sheet P of the stack of sheets P accommodated in the sheet feeder 12 toward a conveyance path.

Thereafter, the sheet P reaches the registration roller pair 16. The sheet P that has reached the registration roller pair 16 is fed to the transfer nip (i.e., the contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance path. In the fixing device 20, the sheet P is interposed between the fixing roller 21 and the pressure roller 22. The toner image is fixed on the sheet P by heat applied from the fixing roller 21 and pressure applied from both the fixing roller 21 and the pressure roller 22. The sheet P having the fixed toner image thereon is discharged from the fixing nip formed between the fixing roller 21 and the pressure roller 22, ejected from the body of the image forming apparatus 100, and stacked on an output tray.

Accordingly, a series of the image forming processes is completed.

Figure 3A:
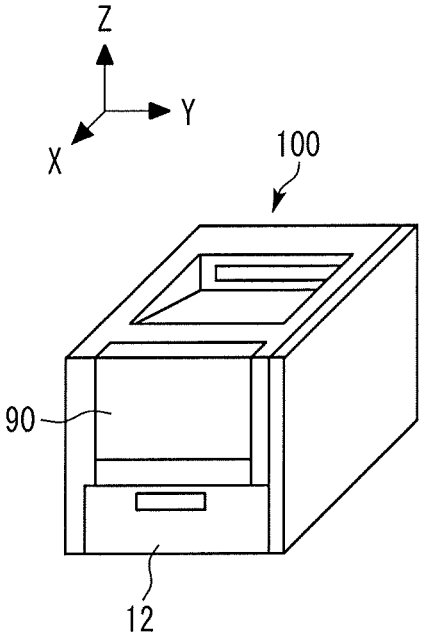
FIG. 3A is a perspective view of the image forming apparatus with a cover closed according to an embodiment of the present disclosure.
Figure 3B:
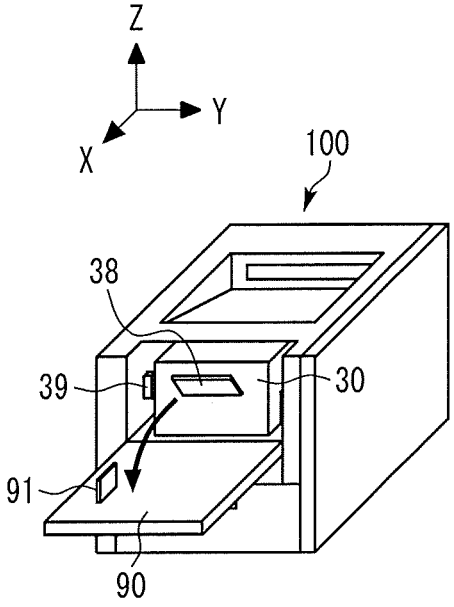
FIG. 3B is a perspective view of the image forming apparatus with the cover open according to an embodiment of the present disclosure.

According to the present embodiment, the image forming apparatus 100 is covered with a plurality of exterior covers as illustrated in FIG. 3A. As illustrated in FIG. 3B, a part of a front exterior cover functions as the cover 90 that is rotatable.

More specifically, the cover 90 is secured to the image forming apparatus 100 and hinged around a spindle (a rotation center shaft) 90*a* as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

In the present embodiment, as illustrated in FIG. 3B, the toner container (the powder container) 30 is revealed to be installable in and removable from the image forming apparatus 100 when the cover 90 opens. By opening the cover 90, the toner container 30 alone (illustrated in FIG. 7) can be replaced with a new toner container, or the toner container 30 together with the process cartridge 10 can be replaced with a new one (the process cartridge 10 and the toner container 30 illustrated in FIG. 4).

Image forming processes (printing operations) described above with reference to FIG. 1 are performed when the cover 90 closes as illustrated in FIG. 1.

The configuration and operation of the toner container (the powder container) 30 according to the present embodiment are described in further detail below.

In the present embodiment, as illustrated in FIG. 2, the toner container 30 as the powder container is attachable to and detachable from the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 as the powder container is indirectly installable in and removable from the image forming apparatus 100.

In the present embodiment, the toner container 30 is indirectly installable in and removable from the image forming apparatus 100. Alternatively, the toner container 30 can be directly installable in and removable from the image forming apparatus 100.

The process cartridge 10 is the removable component that is installable in and removable from the image forming apparatus 100. Besides the process cartridge 10, the developing device 5 and other devices can function as the removable components. The toner container (the powder container) 30 can be attachable to and detachable from a removable component other than the process cartridge 10.

Figure 4:
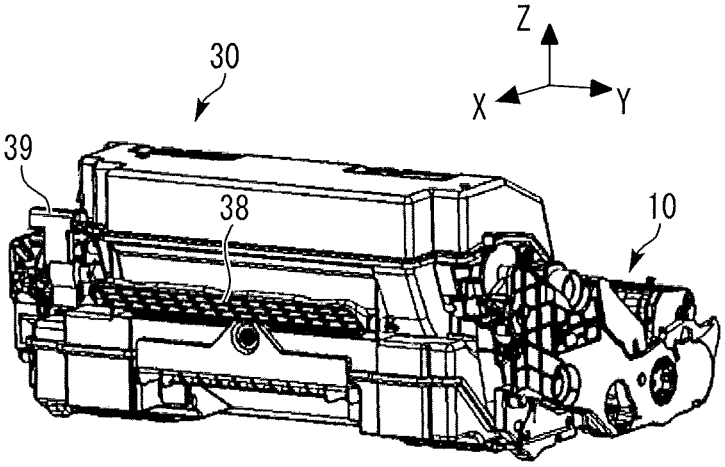
FIG. 4 is a perspective view of the process cartridge to which the toner container is attached.
Figure 5:
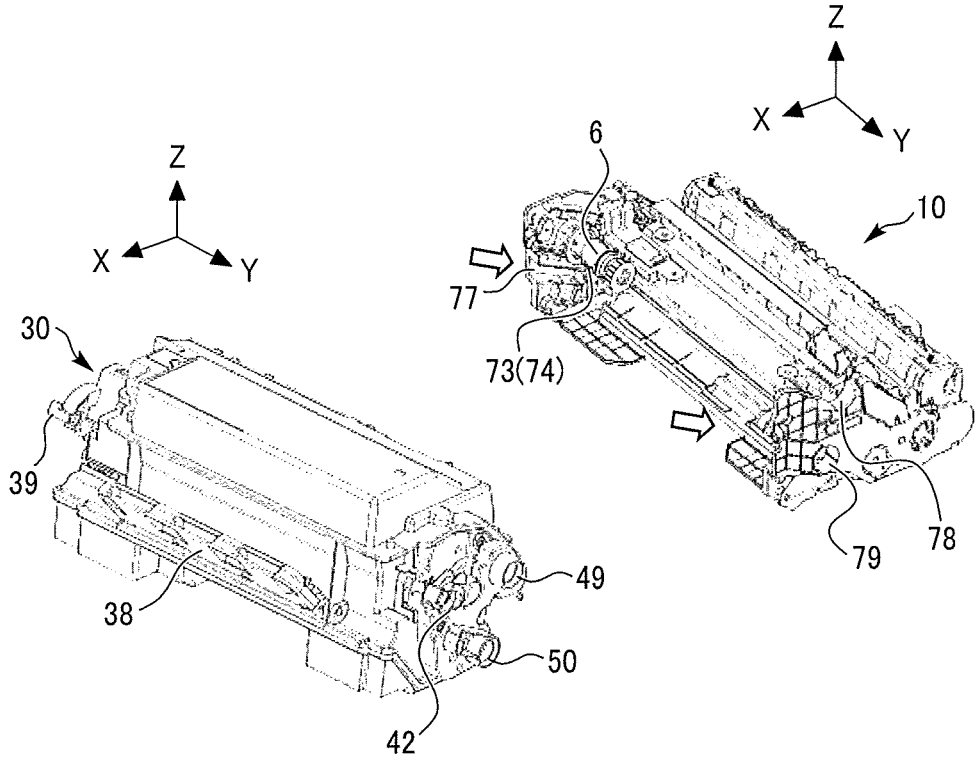
FIG. 5 is a perspective view of the process cartridge from which the toner container is detached.
Figure 6A:
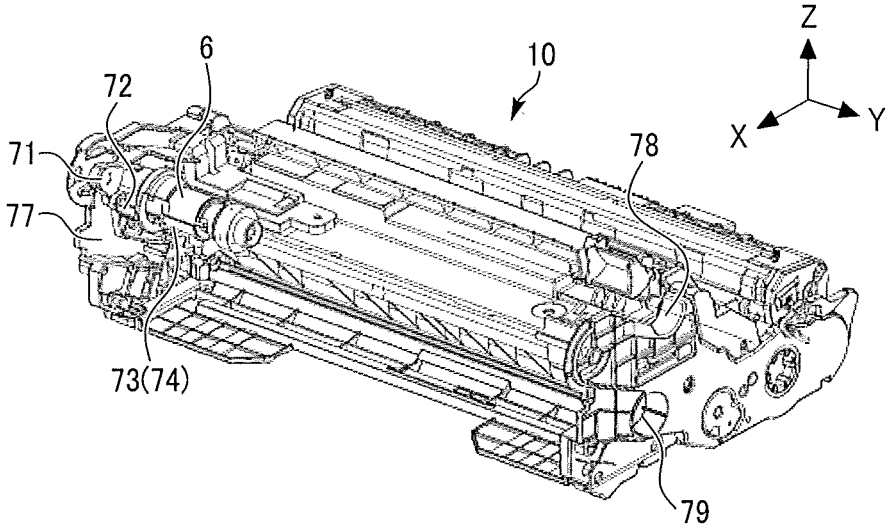
FIGS. 6A and 6B are perspective views of the process cartridge.
Figure 6B:
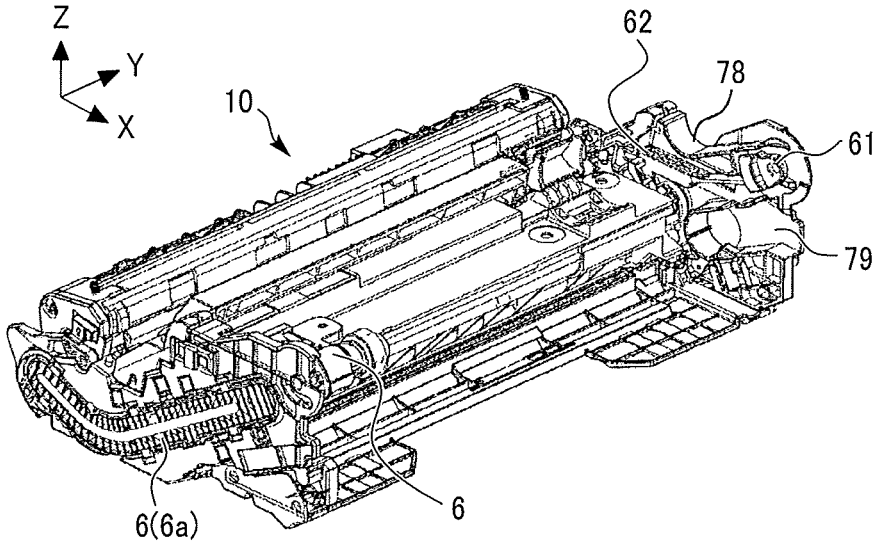
Figure 7:
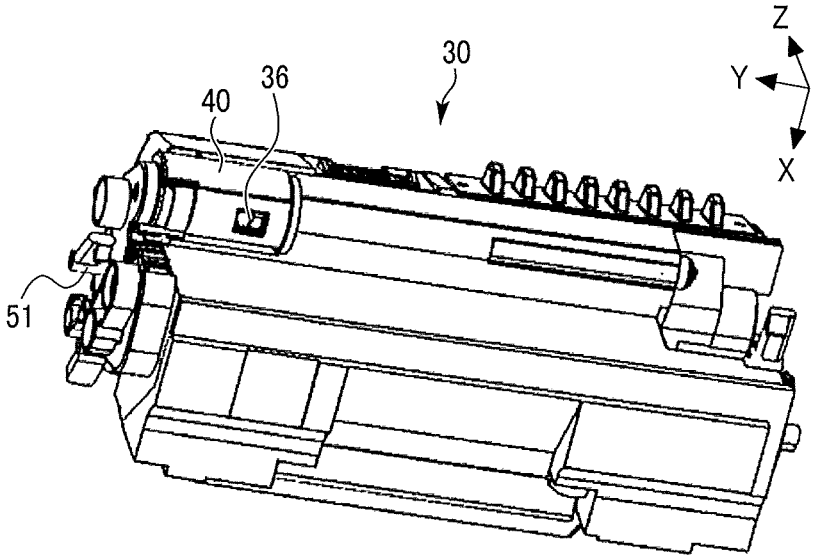
FIG. 7 is a perspective view of the toner container with a first shutter (a discharge port) open when viewed from below.

Furthermore, as illustrated in FIG. 4, one removable component (the toner container 30 and the process cartridge 10) in which the toner container 30 is attached to the process cartridge 10 is installable in and removable from the image forming apparatus 100. As illustrated in FIG. 5, the toner container 30 can be attached to the process cartridge 10, moving in a predetermined direction indicated by white arrow in FIG. 5. On the other hand, the toner container 30 can be removed from the process cartridge 10, moving in a direction opposite to the predetermined direction. The toner container 30 alone as illustrated in FIG. 7 is distributed in the market. The process cartridge 10 alone as illustrated in FIGS. 6A and 6B is similarly distributed in the market.

When the toner container 30 is attached to or detached from the process cartridge 10 (or the image forming apparatus 100), an operator, such as a user, pulls out or pushes in the toner container 30, gripping a handle 38 of the toner container 30. The handle 38 is attached to the front side of the toner container 30 in a direction of detachment operation (positive X-direction) as illustrated FIGS. 2 to 5. The handle 38 is foldable. When the cover 90 close in a state in which the toner container 30 is installed in the image forming apparatus 100 with the handle 38 standing up as illustrated in FIGS. 4 and 5, the handle 38 is pushed by the cover 90 in conjunction with movement of the cover 90 from open state to closed state, thereby accommodating the handle 38 along an exterior of the toner container 30.

Figure 8:
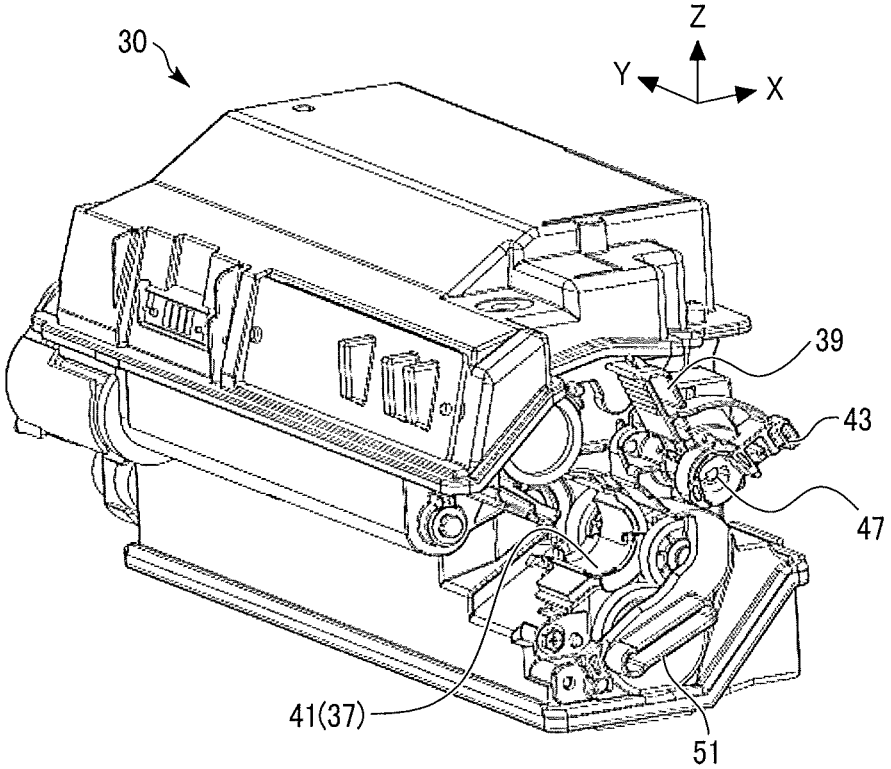
FIG. 8 is a perspective view of the toner container with a second shutter (a collection port) closed when viewed from the collection port side.

The toner container 30 includes first and second positioning portions 49 and 50 illustrated in FIG. 5 and a guide 51 illustrated in FIGS. 7 and 8. The process cartridge 10 has multiple guide grooves 77 and 79 and a guide receiver 78 illustrated in FIG. 5. The first and second positioning portions 49 and 50 and the guide 51 engage with the guide receiver 78 and the multiple guide grooves 79 and 77, respectively. Thus, the toner container 30 can be attached to and detached from the process cartridge 10 and positioned in the process cartridge 10.

Specifically, the first and second positioning portions (positioning projections) 49 and 50 project from one end face of the toner container 30 in the width direction of the toner container 30 (positive Y-direction). The guide receiver 78 and the guide groove 79 are formed on one end face of the process cartridge 10 corresponding the one end face of the toner container 30. The guide 51 projects from the other end face of the toner container 30 (negative Y-direction) and has a rectangular shape which is inclined upward in positive X-direction. The guide receiver 78 introduces the first positioning portion 49, the guide groove 79 introduces the second positioning portion 50, and the guide groove 77 formed on the other end face of the process cartridge 10 introduces the guide 51. Thus, the toner container 30 is attached to the process cartridge 10. The toner container 30 is positioned in the process cartridge 10 so that the first and second positioning portions 49 and 50 engage with dead ends of the guide receiver 78 and the guide groove 79, respectively, and the guide 51 engages with a dead end of the guide groove 77.

The first positioning portion 49 is a projection surrounding a coupling 33*c* (see FIG. 18) that transmits driving force from the image forming apparatus 100 to a first stirrer 33 (see FIGS. 2 and 9) to stir toner. The second positioning portion 50 is a projection surrounding a coupling gear to rotate a waste toner conveying screw 35 (see FIGS. 2 and 9). As described above, input portions to receive the driving force from the image forming apparatus 100 are disposed near (inside) the first and second positioning portions 49 and 50, causing reliable driving force transmission.

The toner container (the powder container) 30 includes a discharge port 36, a collection port 37, a first shutter 40, and a second shutter 41.

Figure 9:
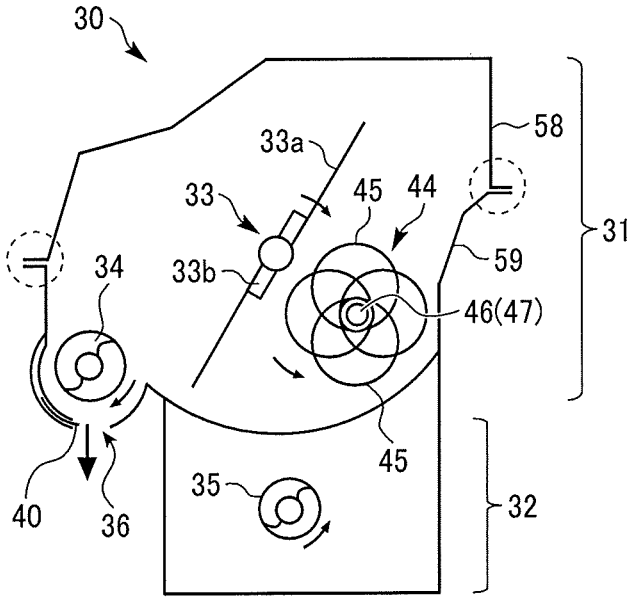
FIG. 9 is a schematic view of an inside of the toner container.

With reference to FIGS. 2, 7, and 9, the discharge port 36 of the toner container 30 is an opening for discharging toner (powder) stored in the toner container 30 (the toner storage 31) to the developing device 5. The discharge port 36 communicates with the inlet port 64 of the developing device 5 when the toner container 30 is attached to the process cartridge 10. The inlet port 64 is an opening disposed above the conveying screw 5*c*.

Figure 10:
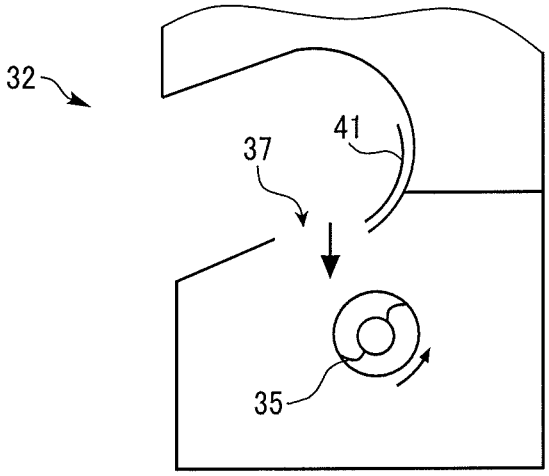
FIG. 10 is a schematic view illustrating a waste toner collection portion of the toner container and environs thereof.

With reference to FIGS. 2, 8, and 10, the collection port 37 of the toner container 30 is an opening to receive waste toner (untransferred toner) as powder from the outside of the toner container 30 and collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

In the toner container 30 according to the present embodiment, with reference to FIGS. 2, 9, and 10, the toner storage 31 as the powder storage to store toner (powder) to be discharged from the discharge port 36 is separated from the waste toner collection portion 32 as the powder collection portion to collect the waste toner (powder) received from the collection port 37 by a wall.

The toner storage (the powder storage) 31 further includes a supply screw 34 to rotate clockwise in FIGS. 2 and 9, the first stirrer (an agitator) 33 as a rotator to rotate clockwise in FIGS. 2 and 9, and a second stirrer (a coil-shaped stirrer) 44. The second stirrer 44 is rotated counterclockwise in FIGS. 2 and 9 by contact with the first stirrer 33.

The supply screw 34 discharges a target amount of toner stored in the toner storage 31 from the discharge port 36 according to a drive timing and rotation duration controlled by a controller.

The first stirrer (the agitator) 33 as the rotator rotates in a predetermined direction (clockwise direction in FIGS. 2 and 9 in the present embodiment) to stir toner stored in the toner storage 31 to prevent toner from aggregating. As illustrated in FIG. 9, the first stirrer 33 includes a contact part (a rigid body) 33*b* and a flexible member 33*a*. The contact part 33*b* is plate-shaped and disposed across a rotation axis of the first stirrer 33, and the flexible member 33*a* is made of plastic sheet and attached to the contact part 33*b* along the contact part 33*b*. Both ends of the first stirrer 33 in the axial direction thereof are rotatably supported by the housing of the toner container 30 through a pair of bearings, respectively.

The second stirrer 44 stirs toner in a region of the toner storage 31 where the first stirrer 33 does not sufficiently stir. The second stirrer (the coil-shaped stirrer) 44 includes a coil 45 including a plurality of divided coil portions 45*a* to 45*d* and a hollow member (a shaft) 46 to hold the coil 45. A piercing shaft 47 is inserted into the hollow member 46. The piercing shaft 47 is one component included in a mechanism to open and close the first shutter 40 and the second shutter 41 in conjunction with each other. These configuration is described in detail later with reference to FIGS. 15 and 16.

In the waste toner collection portion (the powder collection portion) 32, the waste toner conveying screw 35 to rotate counterclockwise in FIG. 2 is disposed. The waste toner conveying screw 35 conveys waste toner so that the waste toner that flows through the collection port 37 does not accumulate near (under) the collection port 37 and is evenly collected (distributed) in the waste toner collection portion 32.

In the present embodiment, as an operator pivots a lever 39 in a state in which the toner container 30 is attached to the process cartridge 10 (or the image forming apparatus 100), the first shutter 40 (the discharge port 36) and the second shutter 41 (the collection port 37) simultaneously open and close. In addition to the first and second shutters 40 and 41, the inlet port 64 and the outlet port 74 of the process cartridge 10 also simultaneously open and close. Therefore, open and close failures of the first and second shutters 40 and 41 and first and second cartridge shutters 63 and 73 are prevented.

When the cover 90 opens in a state in which the toner container 30 is installed in the image forming apparatus 100, the lever 39 is revealed as illustrated in FIG. 3B so that the operator can operate the lever 39.

Figure 11:
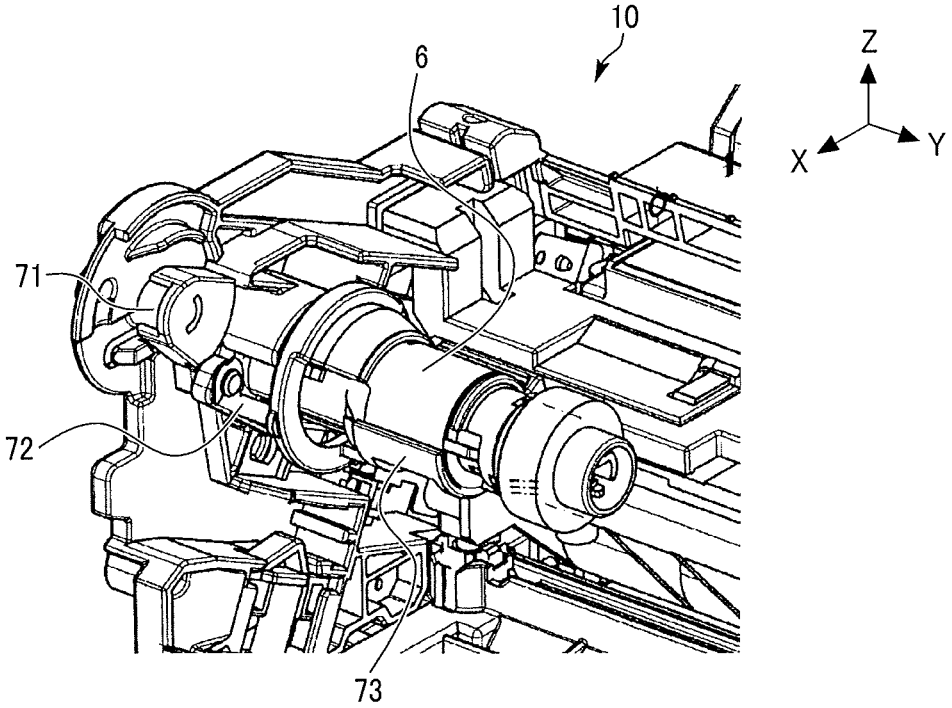
FIG. 11 is an enlarged perspective view illustrating a second engagement portion of the process cartridge.
Figure 12A:
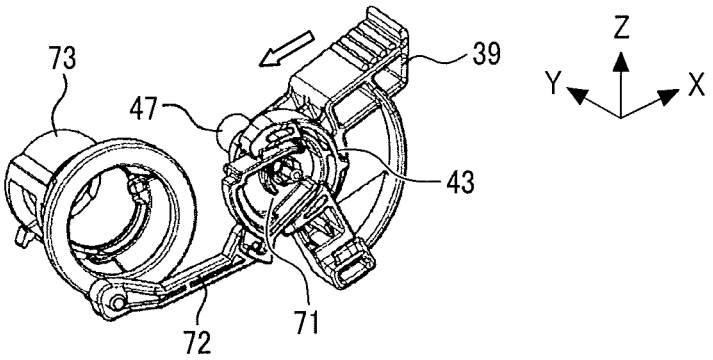
FIGS. 12A and 12B are perspective views illustrating a movement of a second cartridge shutter to open and close in the process cartridge.
Figure 12B:
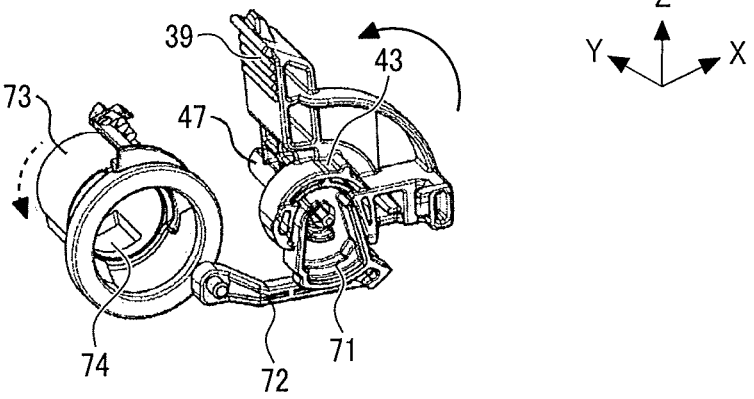

Specifically, as illustrated in FIGS. 8 and 12, the toner container 30 further includes the lever 39 and a second rotation portion 43 formed together with the lever 39 as a single unit to rotate along with the lever 39. The second rotation portion 43 is engageable with a second engagement portion 71 (see FIGS. 11 and 12). The second engagement portion 71 is approximately arc-shaped and included in the process cartridge 10. Specifically, the second rotation portion 43 is shaped as a circle in which a part of the circle is missing in an arc shape. As illustrated in FIG. 12A, when the toner container 30 is attached to the process cartridge 10, the second engagement portion 71 of the process cartridge 10 is inserted in and engages with the second rotation portion 43 of the toner container 30. As illustrated in FIG. 12B, as the lever 39 rotates in a state in which the second engagement portion 71 of the process cartridge 10 engages with the second rotation portion 43 of the toner container 30, the second rotation portion 43 rotates along with the second engagement portion 71, thereby completing engagement of the process cartridge 10 and the toner container 30. Accordingly, the toner container 30 does not move in a direction of pulling out the toner container 30 from the process cartridge 10.

As the second rotation portion 43 is rotated along with the second engagement portion 71 by the lever 39 from a state of FIG. 12A to a state of FIG. 12B, a second link 72 coupled to the second engagement portion 71 of the process cartridge 10 moves in conjunction with the second engagement portion 71 in a direction to open the second cartridge shutter 73 of the process cartridge 10, thereby open the outlet port 74. Further, the second cartridge shutter 73 that moves in the direction to open the second cartridge shutter 73 pushes the second shutter 41 in a direction to open the second shutter 41 of the toner container 30, thereby opening the collection port 37. As a result, the outlet port 74 of the process cartridge 10 communicates with the collection port 37 of the toner container 30. Thus, waste toner is delivered from the process cartridge 10 to the toner container 30 (the waste toner collection portion 32).

When the toner container 30 is detached from the process cartridge 10, the second rotation portion 43 rotates in a reverse direction opposite to the above-described direction along with a reverse rotation of the lever 39, and the second link 72 moves in conjunction with the second rotation portion 43, thereby closing the second cartridge shutter 73 (the outlet port 74) and the second shutter 41 (the collection port 37). As a result, the second rotation portion 43 of the toner container 30 disengages with the second engagement portion 71 of the process cartridge 10.

Figure 13:
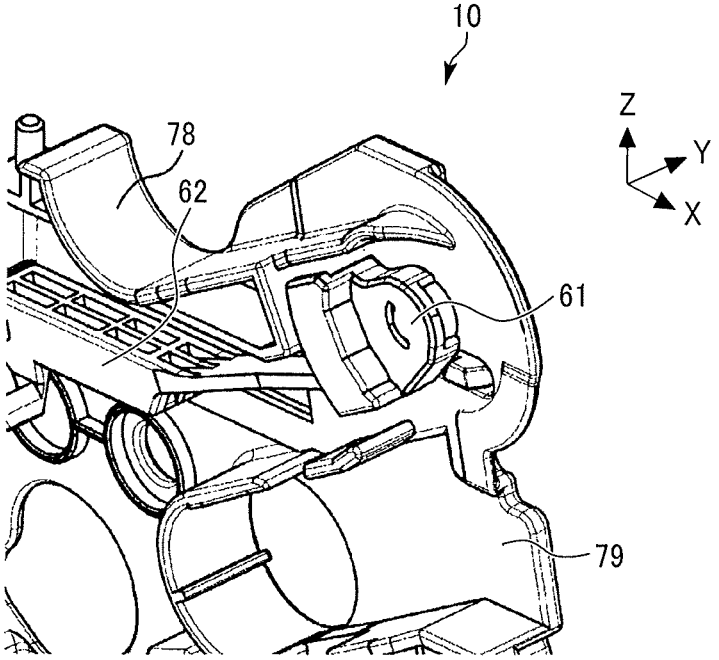
FIG. 13 is an enlarged perspective view illustrating a first engagement portion of the process cartridge.
Figure 14A:
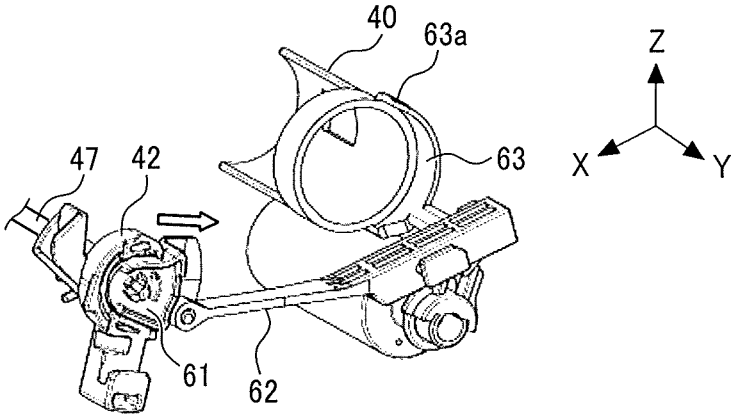
FIGS. 14A and 14B are perspective views illustrating a movement of a first cartridge shutter to open and close in the process cartridge.
Figure 14B:
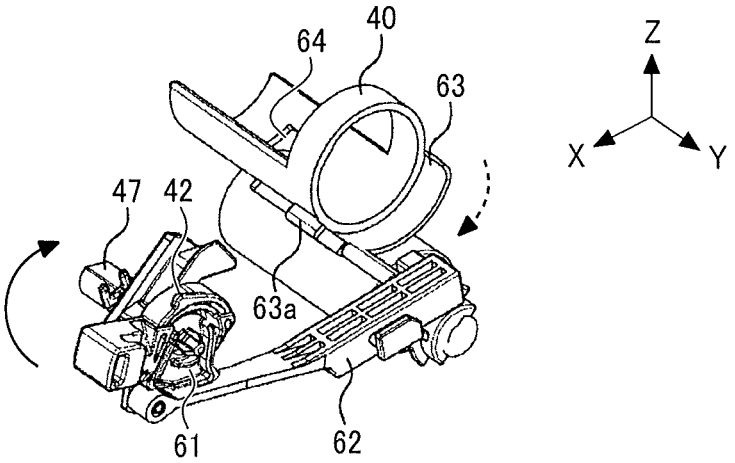
Figure 15:
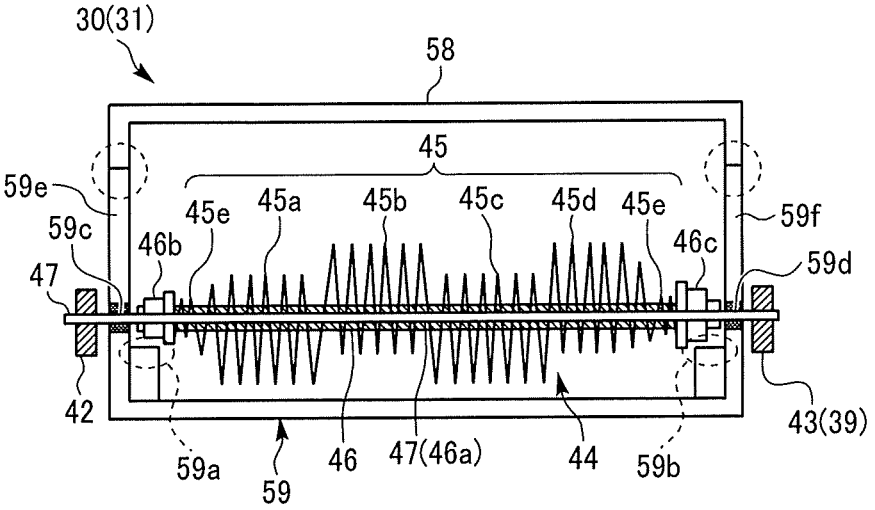
FIG. 15 is a schematic view illustrating a toner storage of the toner container.
Figure 16:
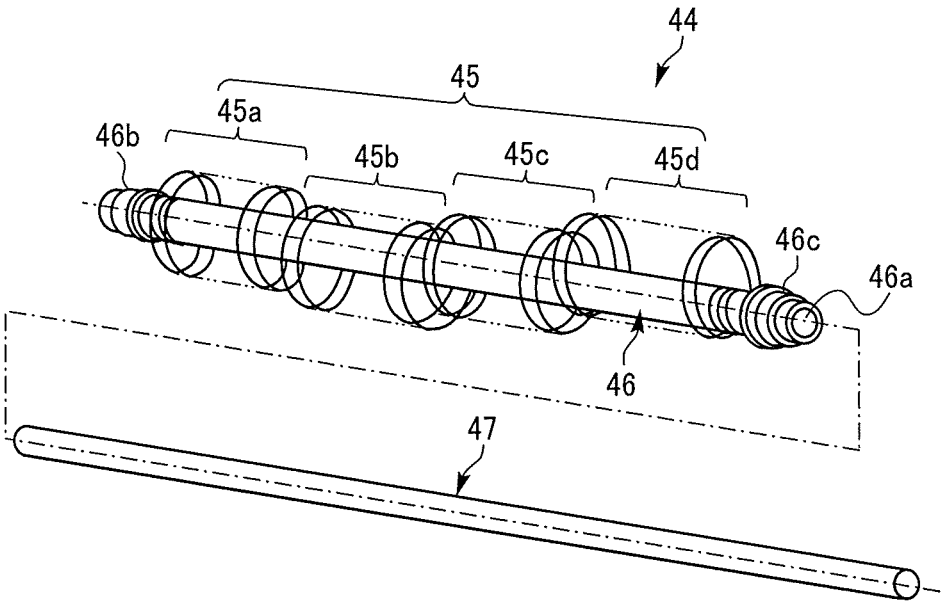
FIG. 16 is a perspective view illustrating a second stirrer of the toner container.

As illustrated in FIGS. 5, 14, and 15, the toner container 30 further includes a first rotation portion 42 disposed opposite the lever 39 (and the second rotation portion 43) in the width direction of the toner container 30. The first rotation portion 42 is coupled to the second rotation portion 43 via the piercing shaft 47 and rotates along with the lever 39 (the second rotation portion 43, and the piercing shaft 47). The first rotation portion 42 is engageable with a first engagement portion 61 (see FIGS. 13, 14A, and 14B). The first engagement portion 61 is approximately arc-shaped and included in the process cartridge 10. Specifically, the first rotation portion 42 is shaped as a circle in which a part of circle is missing in an arc shape. As illustrated in FIG. 14A, when the toner container 30 is attached to the process cartridge 10, the first engagement portion 61 of the process cartridge 10 is inserted in and engages with the first rotation portion 42 of the toner container 30. As illustrated in FIG. 14B, as the lever 39 (and the second rotation portion 43) rotates in a state in which the first engagement portion 61 of the process cartridge 10 engages with the first rotation portion 42 of the toner container 30, the first rotation portion 42 rotates along with the first engagement portion 61 via the piercing shaft 47, thereby completing engagement of the process cartridge 10 and the toner container 30. Accordingly, the toner container 30 does not move in a direction of pulling out the toner container 30 from the process cartridge 10.

As the first rotation portion 42 rotates along with the first engagement portion 61 by the lever 39 from a state of FIG. 14A to a state of 14B, a first link 62 coupled to the first engagement portion 61 of the process cartridge 10 moves in conjunction with the first engagement portion 61 in a direction to open the first cartridge shutter 63 of the process cartridge 10, thereby opening the inlet port 64. Further, a pushing portion 63*a* of the first cartridge shutter 63 that moves in the direction to open the first cartridge shutter 63 pushes the first shutter 40 in a direction to open the first shutter 40 of the toner container 30, thereby opening the discharge port 36. As a result, the inlet port 64 of the process cartridge 10 communicates with the discharge port 36 of the toner container 30. Thus, fresh toner is delivered from the toner container 30 (the toner storage 31) to the process cartridge 10 (the developing device 5).

When the toner container 30 is detached from the process cartridge 10, the first rotation portion 42 rotates in a reverse direction opposite to the above-described direction along with a reverse rotation of the lever 39, and the first link 62 moves in conjunction with the first rotation portion 42, thereby closing the first cartridge shutter 63 (the inlet port 64) and the first shutter 40 (the discharge port 36). As a result, the first rotation portion 42 of the toner container 30 disengages with the first engagement portion 61 of the process cartridge 10.

If the toner container 30 is installed in the image forming apparatus 100 in a state in which the lever 39 falls as illustrated in FIG. 5, the lever 39 is pushed by a pushing member 91 (see FIG. 3B) of the cover 90 in conjunction with movement of the cover 90 from open state to closed state, simultaneously causing the first shutter 40 to open the discharge port 36, the first cartridge shutter 63 to open the inlet port 64, the second shutter 41 to open the collection port 37, and the second cartridge shutter 73 to open the outlet port 74. Therefore, a set failure of the toner container 30 can be prevented.

The pushing member 91 is not fixed to the cover 90 in a standing state as illustrated in FIG. 3B. The pushing member 91 is foldable and switchable between the standing state and falling state. The pushing member 91 is in the falling state at the factory shipment. When the pushing member 91 is in the falling state, the lever 39 in the falling state as illustrated in FIG. 4 is not pushed by the pushing member 91 in the closed state of the cover 90. Accordingly, the discharge port 36 and the collection port 37 remain closed. The image forming apparatus 100 is shipped from a factory in a state in which the toner container 30 is installed in the image forming apparatus 100 with the discharge port 36 and the collection port 37 closed by the first and second shutters 40 and 41. Therefore, it is unnecessary to pack and ship the image forming apparatus 100 and the toner container 30 separately, and toner does not leak out of toner container 30 installed in the image forming apparatus 100 due to vibration during transport.

After arrival of the image forming apparatus 100 to a user, the user (or a service person) rotates the pushing member 91 to the standing state. This operation to rotate the pushing member 91 to the standing state is performed in a state in which the cover 90 is open (and the first and second shutters 40 and 41 remain closed). As the user (or the service person) only close the cover 90 after erecting the pushing member 91, the first and second shutters 40 and 41 open. As a result, toner is supplied from the toner container 30 to the empty developing device 5, and the developing device 5 become available in use.

Distinctive configuration and operation of the toner container 30 as the powder container according to the present embodiment are described below.

Figure 17A:
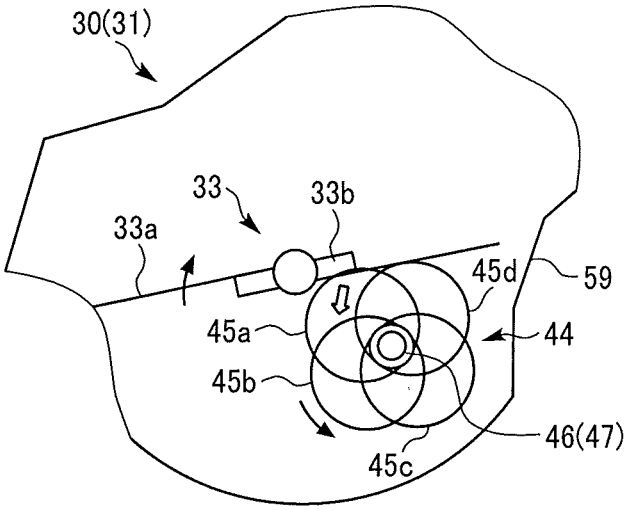
FIGS. 17A and 17B are schematic views illustrating an inside of the toner storage of the toner container.
Figure 18:
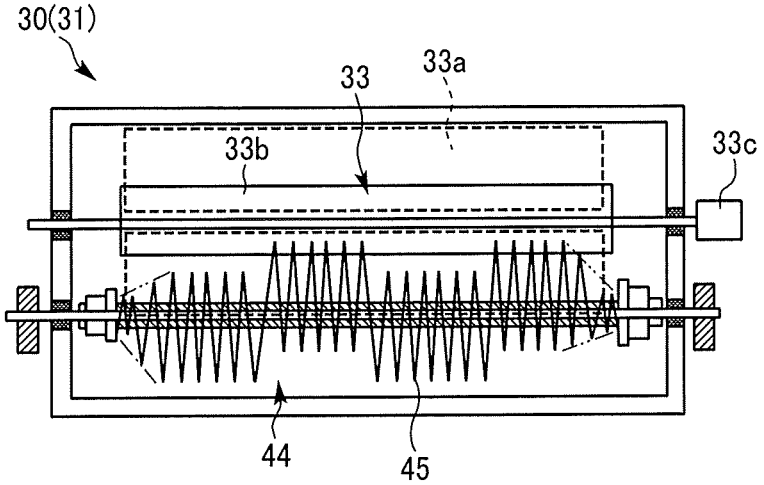
FIG. 18 is a schematic view of a first stirrer of the toner container and the second stirrer.

As described above with reference to FIGS. 2 and 9, the toner container (the powder container) 30 according to the present embodiment includes the first stirrer (the agitator) 33 as the rotator. The first stirrer 33 rotates in a predetermined direction to stir toner (powder) stored in the toner container 30 (the toner storage 31). With reference to FIGS. 17A and 18, a coil 45 is disposed adjacent to the first stirrer 33 and rotated by contact with the first stirrer 33.

Figure 17B:
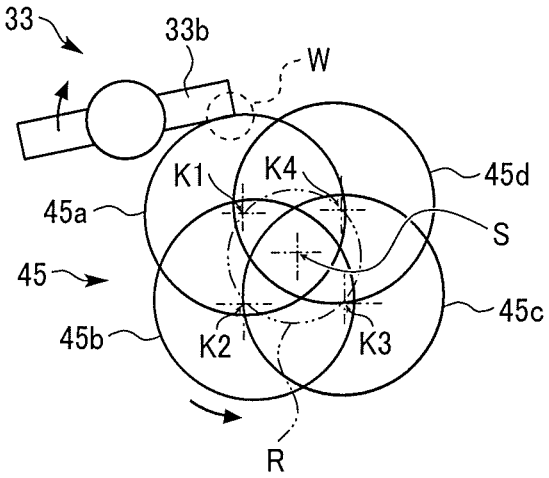

With reference to FIGS. 15 to 17B, the coil 45 is held by the hollow member 46 as the shaft having a shaft center coincident with a rotation center S of the coil 45 (see FIG. 17B). The coil 45 and the hollow member 46 constitute the second stirrer 44 to rotate around the rotation center S. In other words, the second stirrer 44 is a coil-shaped stirrer composed of the coil 45 and the hollow member 46 and stirs toner stored in the toner container 30 (the toner storage 31) together with the first stirrer 33.

The first stirrer (the rotator) 33 is the agitator including the contact part 33*b* as the rigid body to rotate the coil 45 (the second stirrer 44) by contact with the coil 45 and the flexible member 33*a* attached to the contact part 33*b*. The flexible member 33*a* bends when contacting the second stirrer 44. The flexible member 33*a* is flexible enough not to scratch the second stirrer 44 and stiff enough to stir toner stored in the toner storage 31.

Inside the hollow member (the shaft) 46 of the second stirrer 44, the hollow part 46*a* extends in the axial direction of the second stirrer 44 (in the left and right direction in FIG. 15 and perpendicular to the surface of the paper on which FIG. 17A is drawn). Held parts 46*b* and 46*c* are disposed on one end side of the second stirrer 44 and the other end side of the second stirrer 44 in the axial direction of the second stirrer 44, respectively.

Specifically, the hollow member 46 is made of resin. The held parts 46*b* and 46*c* on the both ends of the second stirrer 44 have a larger outer diameter than the main part of the hollow member 46 (a portion around which the coil 45 winds). A hollow part 46*a* penetrates the hollow member 46 from the one end side to the other end side of the second stirrer 44. The held parts 46*b* and 46*c* are used when the second stirrer 44 or the piercing shaft 47 is assembled to the toner container 30 as described later.

The hollow part 46*a* may be anything as long as the piercing shaft 47 to be described later can be inserted into the hollow part 46*a* and is not limited to a closed space with a hollow space closed in the circumferential direction of the piercing shaft 47 (not having openings except at both ends).

The coil 45 of the second stirrer 44 includes small coil portions 45*e* formed at both ends of the coil 45. The small coil portions 45*e* have the same inner diameter as the outer diameter of the hollow member 46 and fits to the hollow member 46. Thus, the coil 45 is held by the hollow member 46 so as to cover the hollow member 46.

The coil 45 rotates counterclockwise in FIG. 17A along with the hollow member 46 and functions as a main part of the second stirrer 44. The second stirrer 44 (the coil 45) stirs toner in the region of the toner storage 31 where the first stirrer 33 does not sufficiently stir. The piercing shaft 47 is disposed in the region to rotate first and second rotation portions 42 and 43 in conjunction with each other. That is, if only the first stirrer 33 stirs toner in the toner storage 31 without the second stirrer 44, the first stirrer 33 contacts the piercing shaft 47, thereby forming a dead space in which the first stirrer 33 does not sufficiently stir toner (a region farther than the piercing shaft 47 based on the first stirrer 33) in the toner storage 31. Therefore, toner staying in the dead space may be agglomerated, causing a toner supply failure. In the present embodiment, since the second stirrer 44 sufficiently stirs toner, such a dead space is not formed, thereby preventing toner from being agglomerated in the toner container 30 (the toner storage 31).

In the present embodiment, the piercing shaft 47 is inserted into the hollow part 46*a* of the hollow member 46 included in the second stirrer 44. The piercing shaft 47 and the second stirrer 44 (the hollow member 46) independently rotate each other.

Specifically, the shaft cross-section of the piercing shaft 47 is circular, and the hole cross-section of the hollow part 46*a* of the hollow member 46 is circular. The hole cross-section has a slightly larger diameter than the shaft cross-section. With such a configuration, irrespective of the rotation of the second stirrer 44 to stir toner in the toner storage 31, the piercing shaft 47 can be rotated by the lever 39 manually operated, thereby rotating the first and second rotation portions 42 and 43 (the first and second shutters 40 and 41, and the first and second cartridge shutters 63 and 73) in conjunction with each other.

The coil 45 (the second stirrer 44) receives driving force by contact of the coil 45 with the first stirrer (the rotator) 33 and is rotated around the rotation center S of the coil 45 (see FIG. 18).

Specifically, as the driving force is transmitted from the image forming apparatus 100 to the coupling 33*c* disposed at an end of the first stirrer 33 in the axial direction (see FIG. 18), the first stirrer 33 rotates clockwise in FIGS. 17A and 17B and impacts the coil 45 (the plurality of divided coil portions 45*a* to 45*d*) with the contact part 33*b*. The impact of the contact part 33*b* elastically deforms the coil 45 (the plurality of divided coil portions 45*a* to 45*d*), and the second stirrer 44 (the coil 45) rotates counterclockwise by repulsive force indicated by white arrow in FIG. 17A to return to the original shape of the coil 45, thereby stirring toner. Since the contact part 33*b* of the first stirrer 33 impacts the coil 45 (the plurality of divided coil portions 45*a* to 45*d*) twice during one revolution of the first stirrer 33, the second stirrer 44 rotates slowly, and a rotational load of the first stirrer 33 does not become too large.

Thus, the second stirrer 44 is rotated by contact of the second stirrer 44 with the first stirrer 33, not by gears. Therefore, a whole driver of the toner container 30 can be simplified.

In the present embodiment, even if the piercing shaft 47 is disposed away from the shaft of the first stirrer 33, the dead space of toner is not formed in the toner storage 31. Accordingly, the opening and closing mechanism of the first and second shutters 40 and 41 (and the first and second cartridge shutters 63 and 73) can be freely laid out. Therefore, the flexibility of design can be improved.

Note that, if the hollow member 46 completely covers the piercing shaft 47, the piercing shaft 47 that penetrates the toner storage 31 is not contaminated with toner.

As illustrated in FIGS. 15 to 18, the coil 45 according to the present embodiment is divided to the plurality of divided coil portions 45*a* to 45*d* in the axial direction of the second stirrer 44. The axial direction is along the rotation center S of the coil 45, the left and right direction in FIGS. 15 and 18, and the same as the width direction of the toner container 30.

As illustrated in FIG. 17B, a plurality of coil centers K1 to K4 of the plurality of divided coil portions 45*a* to 45*d* are eccentric relative to the rotation center S (the shaft axis of the hollow member 46). As illustrated in FIG. 17B, the plurality of coil centers K1 to K4 of the plurality of divided coil portions 45*a* to 45*d* are disposed surrounding the rotation center S as viewed in the axial direction of the second stirrer 44.

Figure 19:
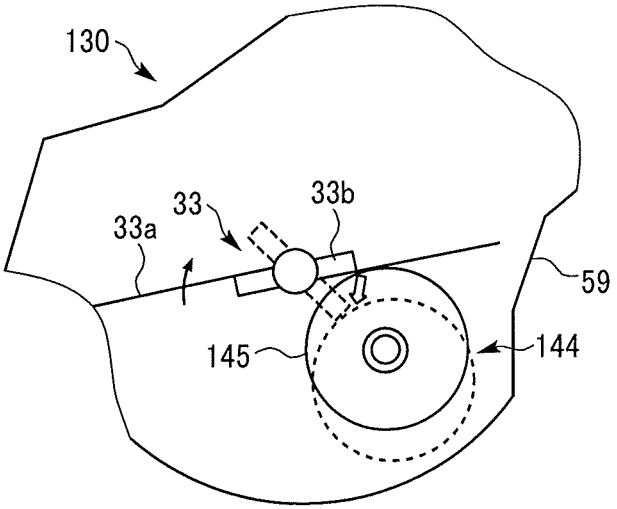
FIG. 19 is an enlarged schematic view of a first stirrer and a second stirrer according to a toner container as a comparative example.

As a toner container 130 illustrated in FIG. 19, if a coil center of a coil 145 of a second stirrer 144 is not eccentric, but the coil 145 is disposed on a circle concentric to the outer circumference of a hollow member and uniformly formed across the axial direction of the second stirrer 144, the coil 145 that the first stirrer 33 impacts is bent at a center portion in the axial direction of the second stirrer 144 as indicated by dashed circle in FIG. 19 and buried in toner in the toner storage 31, causing a state in which the coil 145 stops rotating (or a state in which the coil 145 does not smoothly rotate). In other words, a part of the coil 145 remains deformed as indicated by the dashed circle in FIG. 19, causing a stirring failure such as rotation stop.

In the present embodiment, four divided coil portions 45*a* to 45*d* are eccentric in different directions, respectively, thereby preventing the above-described problem.

In the present embodiment, the first stirrer 33 (the contact part 33*b*) impacts one of the four divided coil portions 45*a* to 45*d*, thereby reducing a load of impact.

With reference to FIG. 17B, the four divided coil portions 45*a* to 45*d* have, even if not the same, substantially same diameters, and respective coil centers K1 to K4 of the four divided coil portions 45*a* to 45*d* are approximately disposed on an imaginary circle R centered on the rotation center S. The coil center K1 of the first divided coil portion 45*a* is disposed opposite the coil center K3 of the third divided coil portion 45*c* across the shaft center of the hollow member 46. The coil center K2 of the second divided coil portion 45*b* is disposed opposite the coil center K4 of the fourth divided coil portion 45*d* across the shaft center of the hollow member 46.

That is, the plurality of coil centers K1 to K4 of the four divided coil portions 45*a* to 45*d* are approximately disposed on the circle R concentric to the outer circumference of the hollow member 46 and at positions equally spaced each other in a rotation direction of the second stirrer 44.

With such a configuration, regardless of the posture of the coil 45 in the rotation direction of the second stirrer 44 due to impact of the first stirrer 33 (the contact part 33*b*), one of the four divided coil portions 45*a* to 45*d* can be constantly located in contact with the first stirrer 33. Therefore, if one of the four divided coil portions 45*a* to 45*d* is buried under toner in the toner storage 31, any of the divided coil portions other than the one of the four divided coil portions 45*a* to 45*d* constantly receives driving force by the first stirrer 33, thereby continuously rotating the coil 45.

In the present embodiment, the contact part 33*b* of the first stirrer (the rotator) 33 contacts the coil 45 to rotate the coil 45. The contact part 33*b* contacts the plurality of divided coil portions 45*a* to 45*d* at a position farther than the plurality of coil centers K1 to K4 relative to the rotation center S as indicated by dashed circle W in FIG. 17B.

That is, a rotation trajectory of the contact part 33*b* of the first stirrer 33 and a rotation trajectory of the coil 45 (the plurality of divided coil portions 45*a* to 45*d*) overlap at a position farther than the plurality of coil centers K1 to K4 relative to the rotation center S.

With such a configuration, rotational power due to contact of the coil 45 with the first stirrer 33 (the contact part 33*b*) is efficiently transmitted to the coil 45 (the plurality of divided coil portions 45*a* to 45*d*), thereby satisfactorily rotating the second stirrer 44.

As described above, the coil 45 includes the two small coil portions 45*e* that sandwiches the plurality of divided coil portions 45*a* to 45*d* from both axial ends of the second stirrer 44. The two small coil portions 45*e* are disposed at both ends of the plurality of divided coil portions 45*a* to 45*d* in the coil 45. The small coil portions 45*e* fit to the hollow member (the shaft) 46 having the shaft center coincident with the rotation center S of the coil 45, causing the hollow member 46 to hold the coil 45.

In the present embodiment, the coil 45 including the four divided coil portions 45*a* to 45*d* and the two small coil portions 45*e* is formed by winding a single wire, and end portions of adjacent to coils are coupled to each other.

As indicated by a long-dashed double-dotted line in FIG. 18, the diameter of each of the small coil portions 45*e* gradually increases toward one of the plurality of divided coil portions 45*a* and 45*d* adjacent to the two small coil portions 45*e*. That is, the coil diameter gradually increases toward the left at the boundary between the right side small coil portion 45*e* and the adjacent to divided coil portion 45*d* in FIG. 18, and the coil diameter gradually increases toward the right at the boundary between the left side small coil portion 45*e* and the adjacent to divided coil portion 45*a* in FIG. 18.

With such a configuration, spring characteristic is improved as compared with a configuration in which the coil diameter abruptly changes at the boundaries between the small coil portions 45*e* and the adjacent to divided coil portions 45*a* and 45*d*. Therefore, the repulsive force indicated by white arrow in FIG. 17A that is generated when the coil 45 returns to the original shape after the impact of the contact part 33*b* elastically deforms the coil 45 (the plurality of divided coil portions 45*a* to 45*d*) can be reliably secured, thereby satisfactorily rotating the second stirrer 44.

With reference to FIG. 15, the toner container 30 (the toner storage 31) further includes holders 59*a* and 59*b* to hold the held parts 46*b* and 46*c* of the hollow member 46 on one end side of the second stirrer 44 and the other end side of the second stirrer 44 in the axial direction, respectively, thereby holding the second stirrer 44.

The piercing shaft 47 is inserted into the hollow part 46*a* of the hollow member 46 from the outside of the toner container 30 through a through-hole 59*d* and holds the second stirrer 44 while the second stirrer 44 is held by the holders 59*a* and 59*b*.

Specifically, the toner container 30 (the toner storage 31) can be divided into an upper case 58 and a lower case 59 as illustrated in FIGS. 9 and 15. The lower case 59 is box-shaped case including a bottom and side walls 59*e*, 59*f*, and the like surrounding the four sides of the bottom. The upper case 58 engages with the lower case 59 at positions indicated by dashed circles in FIGS. 9 and 15 so that the upper case 58 covers the upper opening of the lower case 59. The holders 59*a* and 59*b* and the through-holes 59*c* and 59*d* are provided in the lower case 59.

More Specifically, the holders 59*a* and 59*b* are disposed inside the two side walls 59*e* and 59*f* located at both ends of the lower case 59 in the axial direction of the second stirrer 44 and have a concave shape facing upward. The holders 59*a* and 59*b* have an arc-shaped cross-section.

With reference to FIG. 15, the through-holes 59*c* and 59*d* are disposed in the two side walls 59*e* and 59*f* located at the both ends of the lower case 59 in the axial direction of the second stirrer 44 and at positions higher than (above) the holders 59*a* and 59*b* so as to penetrate the side walls 59*e* and 59*f*. In the present embodiment, the through-holes 59*c* and 59*d* are holes of bearings and indirectly formed in the side walls 59*e* and 59*f*. Alternatively, through-holes can be directly formed in the side walls 59*e* and 59*f*. Packings, such as G seals, V rings, or the like, are preferably provided with the through-holes 59*c* and 59*d* to prevent toner from leaking through a gap between the piercing shaft 47 and the through-holes 59*c* and 59*d*.

A length of the second stirrer 44 is shorter than a distance between inner surfaces of the two side walls 59*e* and 59*f* in the axial direction of the second stirrer 44. A length of the piercing shaft 47 is longer than a distance between outer surfaces of the two side walls 59*e* and 59*f* in the axial direction of the second stirrer 44.

In the process of manufacturing the toner container 30, the second stirrer 44 is placed in the lower case 59 with the upper case 58 removed so that the held parts 46*b* and 46*c* of the hollow member 46 fit to the holders 59*a* and 59*b* of the lower case 59.

The piercing shaft 47 is inserted into the hollow part 46*a* of the second stirrer 44 placed in the lower case 59, from the outside of the toner container 30 through one of the through-holes 59*c* and 59*d* of the two side walls 59*e* and 59*f*. Then, the piercing shaft 47 penetrates the through-holes 59*c* and 59*d* of the two side walls 59*e* and 59*f* and is held by the lower case 59.

Thus, the toner container 30 according to the present embodiment includes the piercing shaft 47 that is inserted into the hollow part 46*a* of the hollow member 46 from the outside of the toner container 30 through the through-hole 59*d* and holds the second stirrer 44 while the second stirrer 44 is held by the holders 59*a* and 59*b*.

Therefore, even if the second stirrer 44 is rotatably held in the toner container 30 that is box-shaped, inconveniences do not occur that it takes time and effort to assemble the toner container 30 or an assembly failure occurs in the manufacturing process, thereby improving assembly efficiency of the toner container 30.

The second stirrer 44 according to the present embodiment includes the coil 45. In a case of assembly of the piercing shaft 47 without the hollow member 46 and the holders 59*a* and 59*b*, an operator inserts the piercing shaft 47 into the inside of the coil 45 from the outside of the toner container 30, while holding the coil 45 with operator's hand. Therefore, unignorable inconvenience is caused that the piercing shaft 47 is entangled with the coil 45. Further, the coil 45 according to the present embodiment includes the plurality of divided coil portions 45*a* to 45*d* eccentric in four directions. Accordingly, the piercing shaft 47 is more likely to be entangled with the divided coil portions 45*a* to 45*d* without the hollow member 46 when inserted.

On the other hand, in the present embodiment, since the piercing shaft 47 moves inside the hollow member 46 in series of operations in which the piercing shaft 47 is inserted into the second stirrer 44 (the coil 45), the piercing shaft 47 is not entangled with the coil 45. Therefore, the assembly efficiency of the toner container 30 is improved.

In the present embodiment, the length of the second stirrer 44 is shorter than the distance between the inner surfaces of the two side walls 59*e* and 59*f* in the axial direction of the second stirrer 44. Therefore, the lower case 59 is formed in a box shape without configurations in which the two side walls 59*e* and 59*f* are splittable relative to the bottom or splittable up and down based on positions of the through-holes 59*c* and 59*d* of the two side walls 59*e* and 59*f*. As a result, toner leak from the lower case 59 is prevented without seal at a seam of the split lower cases.

As illustrated in FIG. 15, when assembly of the toner container 30 is completed, the second stirrer 44 is held by the toner container 30 via the piercing shaft 47 in a state in which the held parts 46*b* and 46*c* are away from (not in contact with) the holders 59*a* and 59*b* of the lower case 59.

Thus, when the second stirrer 44 stirs toner in the toner storage 31, the holders 59*a* and 59*b* do not cause sliding resistance. Therefore, the second stirrer 44 satisfactorily rotates, and abrasion deterioration of the holders 59*a* and 59*b* and the held parts 46*b* and 46*c* due to rotation of the second stirrer 44 is prevented.

As described above, the toner container (the powder container) 30 according to the present embodiment includes the coil 45 disposed adjacent to the first stirrer (the rotator) 33, which rotates in a predetermined direction. The coil 45 is rotated by contact with the first stirrer 33. The coil 45 is divided into the plurality of divided coil portions 45*a* to 45*d* along the rotation center S of the coil 45 in the axial direction of the second stirrer 44. The respective coil centers K1 to K4 of the plurality of divided coil portions 45*a* to 45*d* are eccentric relative to the rotation center S.

Thus, the coil 45 is satisfactorily rotated by contact with first stirrer 33. Therefore, according to the above-described embodiments of the present disclosure, the toner container 30 as a powder container in which the coil 45 as a coil is preferably rotated by contact with the first stirrer 33 as a rotator, the process cartridge 10 as a process cartridge including the powder container, and the image forming apparatus 100 as an image forming apparatus including the process cartridge can be provided.

In the above-described embodiments, the present disclosure is applied to the process cartridge 10 as a single unit including the photoconductor drum 1 (an image bearer), the charging roller (a charger) 4, the developing device 5, the cleaner 2, and the waste toner conveyor 6. However, the present disclosure is not limited to the embodiments described above and applied to the image forming apparatus 100 in which the above-describe devices (i.e., the photoconductor drum 1 as the image bearer, the charging roller 4, the developing device 5, the cleaner 2, and the waste toner conveyor 6) are removably installed as a single unit, respectively.

In such configurations, similar effects to the embodiments described above are also attained.

It is to be noted that the term "process cartridge" used in the present disclosure means a removable device (a removable unit) including an image bearer and at least one of a charger to charge the image bearer, a developing device to develop latent images on the image bearer, and a cleaner to clean the image bearer united together and is designed to be removably installed together in the apparatus body of the image forming apparatus.

In the above-described embodiments, the present disclosure is applied to the toner container (the powder container) 30 included in the image forming apparatus 100 that performs monochrome image formation. Alternatively, the present disclosure may be applied naturally to a toner container (a powder container) included in a color image forming apparatus.

In the above-described embodiments, the present disclosure is applied to the toner container (the powder container) 30 indirectly installed in and removed from the image forming apparatus 100 via the process cartridge 10. Alternatively, the present disclosure may be applied to a toner container (a powder container) directly installed in and removed from the image forming apparatus 100 without going through the process cartridge 10.

In the above-described embodiments, the present disclosure is applied to the toner container (the powder container) 30 to store toner (one-component developer) and supply the toner to the developing device 5 for one-component developing method. Alternatively, the present disclosure may be applied to a toner container (a powder container) to supply toner to the developing device 5 for two-component developing method.

In the above-described embodiments, the present disclosure is applied to the toner container (the powder container) 30 in which toner (one-component developer) as powder is stored and collected. Alternatively, the present disclosure may be applied to a toner container (a powder container) in which two-component developer as powder is stored and collected. The two-component developer is a mixture of toner and carrier. In this case, a developing device employs two-component developing method.

In the above-described embodiments, the present disclosure is applied to the toner container (the powder container) 30 including the toner storage 31 and the waste toner collection portion 32 as a single unit. Alternatively, the present disclosure may be applied to a toner container (a powder container) including only a toner storage.

Any of the cases described above exhibits similar effect to those of the above-described embodiments.

In the above-described embodiments, the present disclosure is applied to the toner container 30 (toner storage 31) to supply toner as powder to the developing device 5, but a powder container to which the present disclosure is applied is not limited thereto. Alternatively, the present disclosure may be applied to a developing device to store toner as powder and develop a latent image formed on an image bearer to a toner image (for example, the developing device 5 in the above-described embodiments, a united device including a developing device and a toner container, and the like). Further, the present disclosure is applied to other powder containers (for example, the cleaner 2 or the waste toner collection portion 32) included in the image forming apparatus and yet other powder containers included in any device other than the image forming apparatus as long as powder is stored therein.

Any of the cases described above exhibits similar effect to those of the above-described embodiments.

In the above-described embodiments, the coil 45 includes the four divided coil portions 45*a* to 45*d*, but the number of the divided coil portions is not limited thereto.

In the above-described embodiments, the shaft to hold the coil 45 is the hollow member 46 to install the piercing shaft 47 in the toner container 30. Alternatively, the shaft to hold the coil 45 can be a solid member without using the piercing shaft 47.

Any of the cases described above exhibits similar effect to those of the above-described embodiments.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. For example, elements and/or features of different illustrative embodiments may be combined with each other and/or substituted for each other within the scope of the present disclosure. The number, position, and shape of the components described above are not limited to those embodiments described above. Desirable number, position, and shape can be determined to perform the present disclosure.

Note that, in the present disclosure, the powder container is a device configured to stir powder to be used in the image forming apparatus or stir used powder in the image forming apparatus. Therefore, the powder container includes a device configured to stir fresh toner or fresh developer and a device configured to stir used toner or used developer.

In the present disclosure, the width direction is perpendicular to a direction in which the toner container (the powder container) 30 is attached to the process cartridge 10. The toner container (the powder container) 30 has a longitudinal direction and a short side direction, and the width direction is the longitudinal direction of the toner container (the powder container) 30. In addition, the width direction is a direction in which the shaft of the rotator extends.

In the present disclosure, one end side in the width direction means one portion side when the toner container 30 is divided to two portions at the center of the toner container 30. In the present disclosure, the other end side in the width direction means the other portion side when the toner container 30 is divided to two portions at the center of the toner container 30.

What is claimed is:

1. A powder container, comprising:

a rotator configured to rotate in a predetermined direction about a first rotation axis; and a coil disposed adjacent to the rotator and configured to be rotated by contact with the rotator about a second rotation axis different from the first rotation axis, wherein the coil is divided into a plurality of divided coil portions in an axial direction of the coil along a rotation center of the coil, and a plurality of coil centers of the plurality of divided coil portions are eccentric relative to the rotation center of the coil.

2. The powder container according to claim 1, wherein the plurality of coil centers surrounds the rotation center of the coil as viewed in the axial direction.

3. The powder container according to claim 1, wherein each divided coil portion of the plurality of divided coil portions has a same diameter, and the plurality of coil centers is disposed on an imaginary circle centered on the rotation center of the coil.

4. The powder container according to claim 1, wherein a contact part, of the rotator to contact the coil to rotate the coil, is configured to contact the plurality of divided coil portions at a position farther than the plurality of coil centers from the rotation center of the coil.

5. The powder container according to claim 1, further comprising:

a shaft having a shaft center coincident with the rotation center, wherein the coil includes two small coil portions at both ends of the plurality of divided coil portions in the axial direction of the coil, and the coil is held by the shaft with the two small coil portions fit to the shaft.

6. The powder container according to claim 5, wherein the coil is made of wire, and a diameter of each of the two small coil portions gradually increases toward one of the plurality of divided coil portions adjacent to each of the two small coil portions.

7. The powder container according to claim 5, further comprising:

a piercing shaft configured to hold the shaft, wherein the shaft is hollow and formed across the axial direction of the coil, the piercing shaft is inserted into the shaft, and the piercing shaft and the shaft are configured to rotate independently of each other.

8. The powder container according to claim 1, further comprising:

a shaft having a shaft center coincident with the rotation center, wherein the rotator is a first stirrer including:

a contact part that is a rigid body configured to contact the coil to rotate the coil, and a flexible member attached to the contact part, the powder container further comprises a second stirrer including the coil and the shaft, and the coil is held by the shaft and configured to rotate together with the shaft around the rotation center.

9. The powder container according to claim 1, wherein the powder container is one of:

a developing device configured to store toner as powder and develop a latent image formed on an image bearer, and a toner container configured to supply the toner to the developing device.

10. A process cartridge, comprising:

the powder container according to claim 1, wherein the process cartridge is installable in and removable from an image forming apparatus.

11. An image forming apparatus, comprising:

the powder container according to claim 1.

12. A powder container, comprising:

an agitator configured to rotate in a predetermined direction; and a coil disposed adjacent to the agitator and configured to be rotated by contact with the agitator, wherein the coil is divided into a plurality of divided coil portions in an axial direction of the coil along a rotation center of the coil, and a plurality of coil centers of the plurality of divided coil portions are eccentric relative to the rotation center of the coil.

13. The powder container according to claim 12, wherein the plurality of coil centers surrounds the rotation center of the coil as viewed in the axial direction.

14. The powder container according to claim 12, wherein each divided coil portion of the plurality of divided coil portions has a same diameter, and the plurality of coil centers is disposed on an imaginary circle centered on the rotation center of the coil.

15. The powder container according to claim 12, further comprising:

a shaft having a shaft center coincident with the rotation center, wherein the coil includes two small coil portions at both ends of the plurality of divided coil portions in the axial direction of the coil, and the coil is held by the shaft with the two small coil portions fit to the shaft.

16. The powder container according to claim 15, wherein the coil is made of wire, and a diameter of each of the two small coil portions gradually increases toward one of the plurality of divided coil portions adjacent to each of the two small coil portions.

17. The powder container according to claim 15, further comprising:

a piercing shaft configured to hold the shaft, wherein the shaft is hollow and formed across the axial direction of the coil, the piercing shaft is inserted into the shaft, and the piercing shaft and the shaft are configured to rotate independently of each other.

18. The powder container according to claim 12, further comprising:

a shaft having a shaft center coincident with the rotation center, wherein the agitator is a first stirrer including:

a contact part that is a rigid body configured to contact the coil to rotate the coil, and a flexible member attached to the contact part, the powder container further comprises a second stirrer including the coil and the shaft, and the coil is held by the shaft and configured to rotate together with the shaft around the rotation center.

19. The powder container according to claim 12, wherein the powder container is one of:

a developing device configured to store toner as powder and develop a latent image formed on an image bearer, and a toner container configured to supply the toner to the developing device.

20. A powder container, comprising:

a coil; and a rotator adjacent to the coil, the rotator configured to rotate the coil, wherein the coil is divided into a plurality of divided coil portions in an axial direction of the coil along a rotation center of the coil, the rotator includes a contact part that is in contact with the plurality of divided coil portions of the coil to rotate the coil, and a position, at which the contact part is in contact with the plurality of divided coil portions, is further from the rotation center of the coil than the plurality of coil portions are from the rotation center of the coil.

* * * * *